US007025250B2

(12) United States Patent
Wolfe, Jr.

(10) Patent No.: US 7,025,250 B2
(45) Date of Patent: Apr. 11, 2006

(54) AUTOMATIC GRAVITY-ACTUATED MAILBOX INDICATOR

(76) Inventor: Charles William Wolfe, Jr., 2414 Simca Ct., Charlotte, NC (US) 28216

( * ) Notice: Subject to any disclaimer, the term of this patent is extended or adjusted under 35 U.S.C. 154(b) by 0 days.

(21) Appl. No.: 10/925,490

(22) Filed: Aug. 25, 2004

(65) Prior Publication Data

US 2006/0043162 A1 Mar. 2, 2006

(51) Int. Cl.
*B65D 91/00* (2006.01)

(52) U.S. Cl. ..... 232/35

(58) Field of Classification Search ..... 232/35, 232/34; 116/215

See application file for complete search history.

(56) References Cited

U.S. PATENT DOCUMENTS

| | | | | | |
|---|---|---|---|---|---|
| 2,815,167 | A * | 12/1957 | Bailes et al. | ..... | 232/35 |
| 3,547,070 | A * | 12/1970 | Schuh | ..... | 232/35 |
| 3,815,811 | A * | 6/1974 | Harmon | ..... | 232/35 |
| 3,958,752 | A * | 5/1976 | Pieszchala | ..... | 232/35 |
| 4,018,379 | A * | 4/1977 | Carter | ..... | 232/35 |
| 4,782,997 | A * | 11/1988 | Cotton, Jr. | ..... | 232/35 |
| 4,798,326 | A * | 1/1989 | Kirry et al. | ..... | 232/34 |
| 5,427,311 | A * | 6/1995 | Kachmar | ..... | 232/35 |
| 5,927,596 | A | 7/1999 | Trenier | | |
| 6,318,629 | B1 * | 11/2001 | Anderson | ..... | 232/35 |
| D478,702 | S | 8/2003 | Dregney | | |

* cited by examiner

*Primary Examiner*—William L. Miller
(74) *Attorney, Agent, or Firm*—Schwartz Law Firm P.C.

(57) ABSTRACT

An automatic gravity-actuated mailbox indicator is adapted for use in combination with a mailbox including a housing with an access opening for receiving mail and a pivoted door for closing the access opening. The mailbox indicator includes a conspicuous object adapted for being viewed from a distance. A supporting stem extends from the object, and has a free end for being wedged between the pivoted door and housing of the mailbox with the door in a closed position. The object is temporarily held at an elevated location relative to the mailbox housing. The mailbox indicator is actuated by gravity upon movement of the pivoted door from the closed position to an open position, such that the object falls from the elevated location to a lowered location thereby providing a readily visible indication of an opening of the pivoted door.

4 Claims, 3 Drawing Sheets

AUTOMATIC GRAVITY-ACTUATED MAILBOX INDICATOR

TECHNICAL FIELD AND BACKGROUND OF THE INVENTION

This invention relates to an automatic gravity-actuated mailbox indicator. The invention operates to provide a convenient and conspicuous visual indication of movement of the mailbox door from a closed position to an open position. The invention is intended to avoid unnecessary trips to the mailbox, and is especially useful on a mailbox located a remote distance from the residence.

Other automatic mailbox indicators have drawbacks and limitations, and do not operate with the degree of simplicity of the present invention. For example, one indicator described in U.S. Pat. No. 5,927,596 uses a rod linkage located inside the mailbox and attached to the pivoted mailbox door. When the door is opened, the linkage is designed to mechanically actuate an outside signally device. This indicator occupies space inside the mailbox, and appears relatively complicated to install. A second indicator shown in U.S. Pat. No. D478,702 using a spring-loaded signaling flag. The flag is raised by mechanical operation of the spring when the mailbox door is opened. The spring is mounted outside of the mailbox housing, and subject to wear and poor operation resulting from extended use, rain, and snow.

The present invention overcomes these and other problems of the prior art by providing an automatic mailbox indicator which operates entirely on the principle of gravity. The invention has no mechanical or moving parts which require extensive assembly and complicated installation. The invention may be formed in any desired ornamental or decorative shape, and locates entirely on the outside of the mailbox housing to avoid obstructing the deposit of mail inside the housing.

SUMMARY OF INVENTION

Therefore, it is an object of the invention to provide an automatic mailbox indicator which operates entirely on the principle of gravity.

It is another object of the invention to provide an automatic mailbox indicator which is quickly and easily installed in any standard mailbox.

It is another object of the invention to provide an automatic mailbox indicator which is not mechanically actuated and subject to wear.

It is another object of the invention to provide an automatic mailbox indicator which is located entirely outside of the mailbox housing.

It is another object of the invention to provide an automatic mailbox indicator which is relatively inexpensive to manufacture.

It is another object of the invention to provide an automatic mailbox indicator which is decorative.

These and other objects of the present invention are achieved in the preferred embodiments disclosed below by providing an automatic gravity-actuated mailbox indicator. The mailbox indicator is adapted for use in combination with a mailbox including a housing with an access opening for receiving mail and a pivoted door for closing the access opening. The mailbox indicator includes a conspicuous object adapted for being viewed from a distance. A supporting stem extends from the object, and has a free end for being wedged between the pivoted door and housing of the mailbox with the door in a closed position. Means are provided for temporarily holding the object at an elevated location relative to the mailbox housing. The mailbox indicator is actuated by gravity upon movement of the pivoted door from the closed position to an open position, such that the object falls from the elevated location to a lowered location thereby providing a readily visible indication of an opening of the pivoted door.

The "means for temporarily holding the object" includes any structure sufficient to hold the stem in a generally upright condition in order to prevent the object from falling or pivoting downward relative the mailbox housing. This may include, for example, a relatively flat foot integrally-formed with the free end of the stem, as described below. Alternatively, the means may include separate structure which temporarily braces the stem against an outside of the mailbox housing. The means may also include a magnet located on the stem and/or object.

The term "elevated location" refers to any location of the object above the ground.

According to another preferred embodiment of the invention, the conspicuous object is an aesthetic butterfly design.

According to another preferred embodiment of the invention, the supporting stem is constructed of a pliable stainless steel wire.

According to another preferred embodiment of the invention, the free end of the supporting stem has a flat pivot-resisting foot adapted for locating between a perimeter seal flange of the pivoted door and the mailbox housing when the door is in the closed position.

According to another preferred embodiment of the invention, the supporting stem is between 6 and 12 inches long.

According to another preferred embodiment of the invention, a flexible line extends from the object, and is adapted for suspending the indicator from the mailbox housing when actuated.

In another embodiment, the invention is the combination of a mailbox and an automatic gravity-actuated mailbox indicator. The mailbox includes a housing defining an access opening and a pivoted door adapted for closing the opening. A mailbox indicator includes a conspicuous object adapted for being viewed from a distance. A supporting stem extends from the object, and has a free end for being wedged between the pivoted door and housing of the mailbox with the door in a closed position. Means are provided for temporarily holding the object at an elevated location relative to the mailbox housing. The mailbox indicator is actuated by gravity upon movement of the pivoted door from the closed position to an open position, such that the object falls from the elevated location to a lowered location thereby providing a readily visible indication of an opening of the pivoted door.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figures 1, 2:
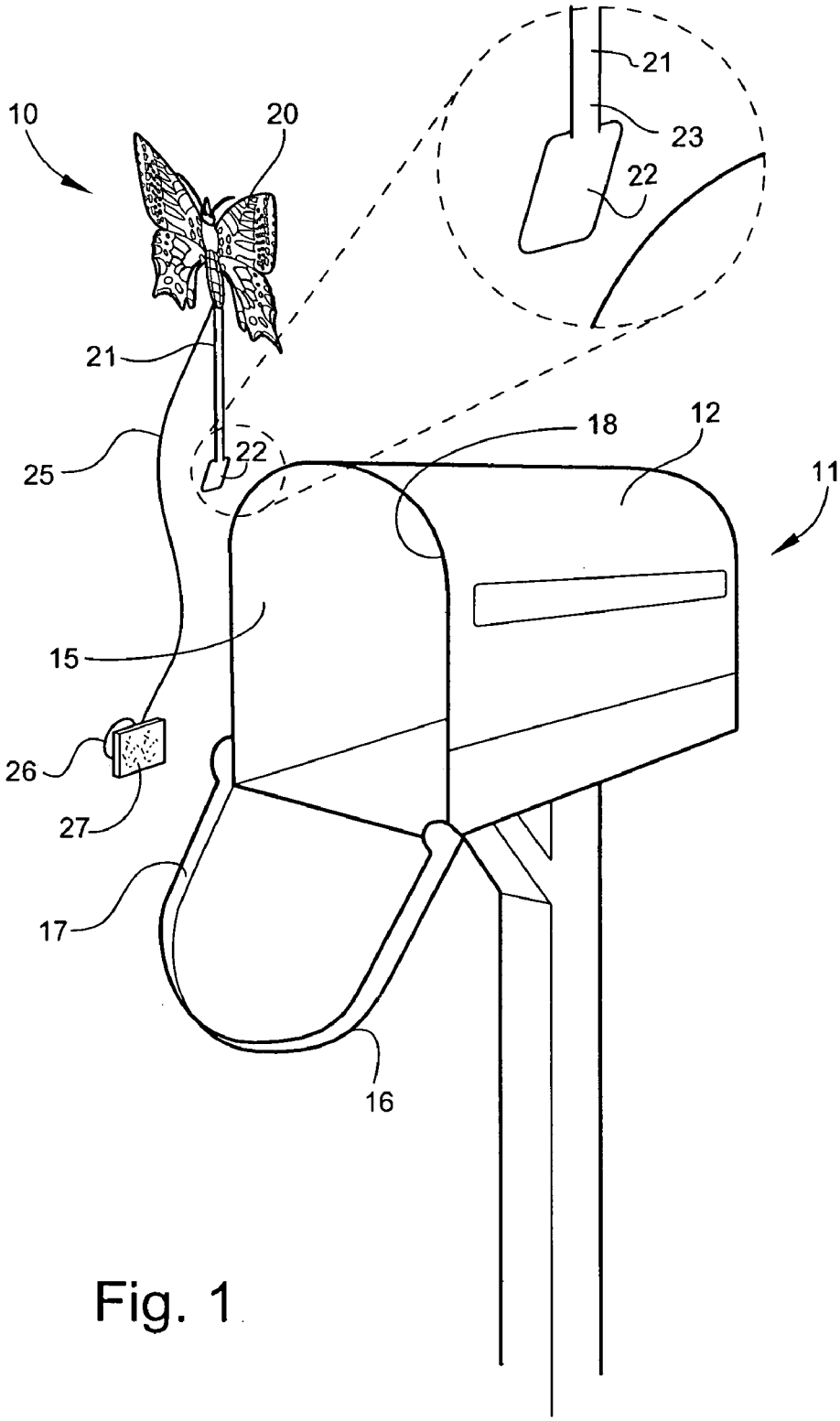
FIG. 1 is a perspective view of a mailbox indicator according to one preferred embodiment of the present invention.
FIG. 2 is an enlarged view of the area indicated at 1A in FIG. 1.

Referring now specifically to the drawings, an automatic gravity-actuated mailbox indicator according to the present invention is illustrated in FIG. 1, and shown generally at reference numeral 10. The mailbox indicator 10 is especially applicable for use on a standard mailbox 11 located away from a residence-typically, at the end of a driveway. The mailbox 11 includes a hollow housing 12 mounted on a vertical post 14 set in the ground. The housing 12 defines an access opening 15 for receiving mail, and has a pivoted door 16 with a perimeter flange 17 designed to cover a mouth 18 of the opening 15 when closed, thereby sealing the inside of the housing 12 against rain. The mailbox indicator 10 is intended to provide a convenient and ready indication of whether mail has arrived in order to avoid unnecessary trips to the mailbox 11.

Referring to FIG. 1, the mailbox indicator 10 comprises a conspicuous decorative object 20, such as a butterfly design, or other suitable shape sufficiently large and distinctive to be easily viewed from a distance. The object 20 is relatively lightweight, durable, and weather-resistant. Other suitable objects may include other ornamental two or three-dimensional designs, flags, and banners.

Figure 3:
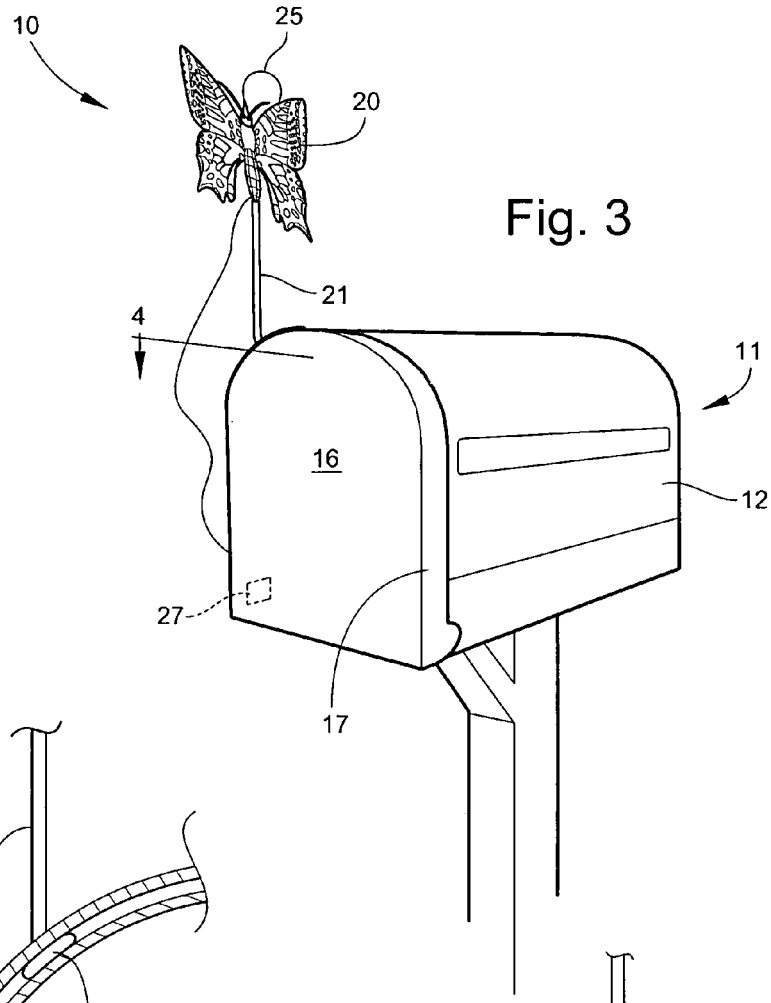
FIG. 3 is a perspective view of the mailbox indicator held to the mailbox with the mailbox door in the closed position.
Figure 4:
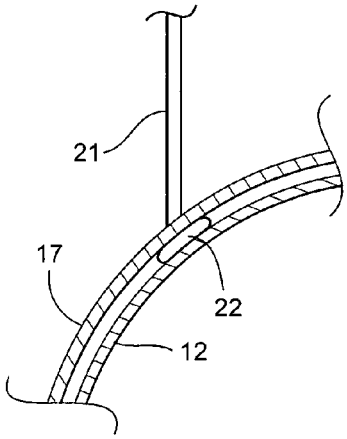
FIG. 4 is a fragmentary cross-sectional view taken substantially along line 4 in FIG. 3.
Figure 5:
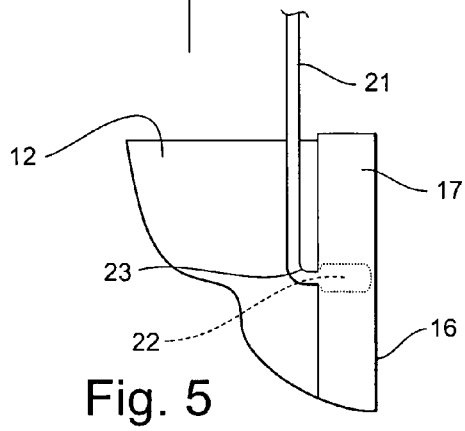
FIG. 5 is a fragmentary side view showing the foot of the indicator stem in phantom between the perimeter flange of the mailbox door and the mailbox housing.

An elongated supporting stem 21 extends from the object 20, and has a relatively flat, integrally-formed foot 22, as best shown in FIG. 2. When the mailbox door 16 is closed, as shown in FIG. 3, the foot 22 locates between the perimeter door flange 17 and the mailbox housing 12, as shown in FIGS. 4 and 5. The foot 22 holds the stem 21 in an outwardly extending pivot-resisting condition, and temporarily maintains the object 20 at an elevated location relative the housing 12. An integral pivot point 23 is formed at the junction of the stem 21 and foot 22 such that once the foot 22 is set between the mailbox door 16 and the housing 12, the stem 21 can be manually manipulated to locate and hold the object 20 at any desired elevation relative to the housing 12. The stem 21 may extend vertically upward as shown in FIG. 3, at a slight angle relative to the post 14, or may be cantilevered outwardly from the side of the housing 12. Preferably, the stem 21 is formed of a rust-resistant stainless steel wire. The strength of the wire at the junction of the stem 21 and foot 22 is sufficient to hold the object 20 at any elevation, yet the wire is sufficiently pliable to allow manual adjustment at the pivot point 23.

Figure 6:
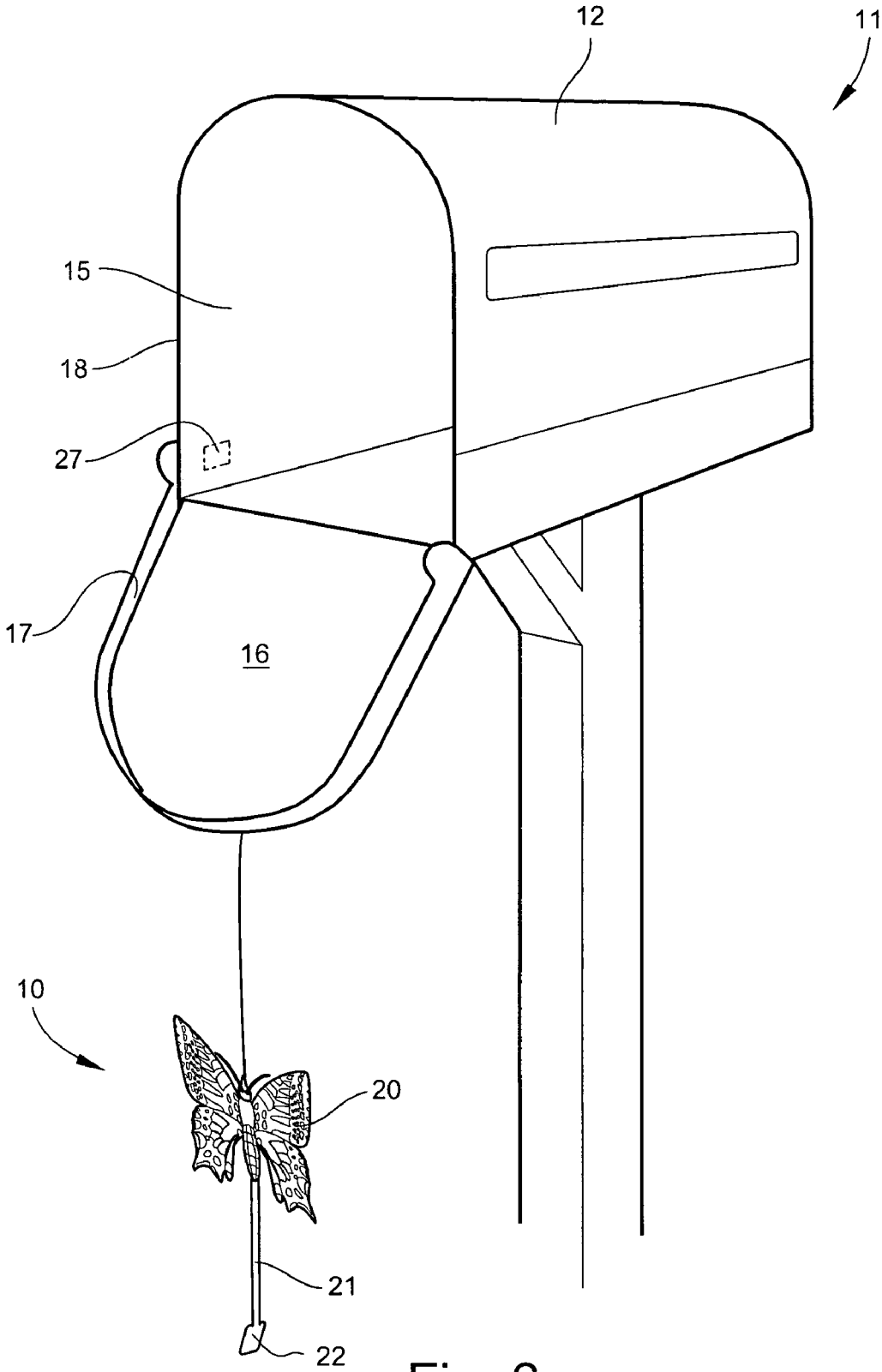
FIG. 6 is a perspective view showing the mailbox door in the open position and the mailbox indicator actuated.

When the mailbox door 16 is opened, as shown in FIG. 6, the foot 22 of the stem 21 is released from its wedged condition between the perimeter door flange 17 and the mailbox housing 12. This causes the object 20 to fall from the elevated location to a lowered location, thereby indicating movement of the mailbox door 16 from the closed position to the opened position. Preferably, a clear nylon line 25 attaches the mailbox indicator 10 to the mailbox housing 12. The free end of the line 25 is secured to a molded plastic hook 26 with a self-adhesive backing 27 for attaching directly to an outside wall of the mailbox housing 12. The nylon line 25 and hook 26 cooperate to suspend the object 20 above the ground after the indicator 10 is actuated.

An automatic gravity-actuated mailbox indicator is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. In combination with a mailbox comprising a housing defining an access opening and a pivoted door adapted for closing said opening, an automatic gravity-actuated mailbox indicator comprising:

a conspicuous object adapted for being viewed from a distance;

a supporting stem extending from said object, and having a free end comprising a flat pivot-resisting foot adapted for locating between a perimeter seal flange of the pivoted door and the mailbox housing when the door is in the closed position;

an integral pivot point formed at a junction between said stem and said foot, such that once said foot is set between the pivoted door and mailbox housing, said stem can be manually manipulated to hold said object at any desired elevation relative to the housing;

whereby said mailbox indicator is actuated by gravity upon movement of the pivoted door from the closed position to an open position, such that said object falls from the elevated location to a lowered location thereby providing a readily visible indication of an opening of the pivoted door;

a clear flexible line extending from said object, and adapted for suspending said mailbox indicator from the mailbox housing when actuated; and a mounting element attached to the flexible line and comprising an adhesive backing for attaching directly to an outside wall of the mailbox housing.

2. A mailbox comprising an automatic mailbox indicator according to claim 1, wherein said conspicuous object comprises an aesthetic butterfly design.

3. A mailbox comprising an automatic mailbox indicator according to claim 1, wherein said supporting stem is constructed of a pliable stainless steel wire.

4. A mailbox comprising an automatic mailbox indicator according to claim 1, wherein said supporting stem is between 6 and 12 inches long.

* * * * *